US006507260B1

(12) United States Patent
Baumann et al.

(10) Patent No.: US 6,507,260 B1
(45) Date of Patent: Jan. 14, 2003

(54) ELECTRICAL TRANSFORMER FOR USE WITH TWISTED PAIR

(75) Inventors: Donald D. Baumann, San Jose, CA (US); Philip H. Sutterlin, Saratoga, CA (US)

(73) Assignee: Echelon Corporation, San Jose, CA (US)

( * ) Notice: Subject to any disclaimer, the term of this patent is extended or adjusted under 35 U.S.C. 154(b) by 0 days.

(21) Appl. No.: 09/561,616

(22) Filed: Apr. 27, 2000

(51) Int. Cl.[7] ..... H01F 27/02
(52) U.S. Cl. ..... 336/90; 336/229
(58) Field of Search ..... 336/84 C, 90, 336/200, 223, 192, 229, 198

(56) References Cited

U.S. PATENT DOCUMENTS 3,964,009 A * 6/1976 Bernstein et al. ..... 336/90
4,578,664 A * 3/1986 Kinzler et al. ..... 336/90
5,214,403 A * 5/1993 Bogaerts et al. ..... 336/84 C

FOREIGN PATENT DOCUMENTS

JP 04-297005 * 10/1992 ..... 336/90

* cited by examiner

*Primary Examiner*—Lincoln Donovan
*Assistant Examiner*—Tuyen T. Nguyen
(74) *Attorney, Agent, or Firm*—Blakely, Sokoloff, Taylor & Zafman LLP

(57) ABSTRACT

A toroidal transformer for a communications application where a first winding is wound on the core. A separator comprising a pair of annular-shaped cups then encloses the core and first winding. A second winding is wound on the outer surface of the separator. The separator, fabricated from a low K material, provides substantial reduction in the capacitance between the first and second winding.

5 Claims, 4 Drawing Sheets

ELECTRICAL TRANSFORMER FOR USE WITH TWISTED PAIR

BACKGROUND

1. Field of the Invention

The invention relates to the field of transformers, particularly transformers useful in connecting a twisted pair transmission line to a transceiver.

2. Prior Art

In many applications where transformers are used for isolation, there is a need to reduce common mode noise coupling between windings and at the same time minimize so-called "open frame" noise caused by magnetic flux from other devices inducing voltages in the windings of the transformer. This is particularly true where transformers are used to isolate a twisted pair communication line, such as a telephone line, from a transceiver.

One of the most effective ways to reduce noise pick-up from stray magnetic flux in transformers is to use a toroidal core with windings uniformly disposed around the full circumference of the toroid. Multiple windings are either wound on top of each other in layers or wound at the same time in a bifilar fashion. Uniformly spreading each winding around the full circumference of the toroid results in cancellation of stray magnetic field pick-up. This is true since windings on opposite sides of the toroid induce opposite polarity signals. Another advantage to tightly coupling primary and secondary windings is that leakage inductance is significantly reduced. Low leakage inductance provides wider transformer bandwidth.

Common mode noise coupling is generally the result of the parasitic capacitive coupling between the windings of the transformer. This capacitance can be most easily reduced by separating the windings, such as by having one winding disposed on one sector of the same core and a second winding disposed on another sector of a toroidal core. With this sector winding technique, the distance between windings is increased and consequently the capacitance between the windings is reduced. In some applications a transformer may need to provide a safety isolation barrier between windings of a transformer in addition to functional isolation requirements. Meeting stringent safety agency insulation and voltage breakdown requirements also leads to greater separation between transformer windings.

Thus, when windings are sector wound, common mode noise coupling is reduced and safety isolation requirements facilitated but noise pick-up from stray magnetic fields is increased and transformer bandwidth is reduced. Conversely, steps taken to reduce noise pick-up from stray magnetic fields tend to increase common mode noise coupling.

As will be seen, the present invention provides a transformer with a separator between the primary and secondary windings which reduces the capacitance and hence the common mode noise and at the same time minimizes noise pick-up from stray magnetic fields and transformer leakage inductance. This same construction also facilitates stringent safety isolation requirements without compromising other functional parameters.

SUMMARY OF THE INVENTION

A transformer is described having a toroidal core and a first winding disposed about the core. A winding separator comprising a pair of annular-shaped cups encircles the first winding. A second winding is disposed about the outer surface of the separator.

In one embodiment a tab extends adjacent an opening which provides access to the interior of the winding separator. The ends of the first winding pass through the opening and are separated from the second winding by the tab. In another embodiment, the interior of the separator includes spacers to provide a further air gap between the first and second windings.

DETAILED DESCRIPTION OF THE INVENTION

A transformer is described, particularly suited for use with a transceiver for providing isolation between a transceiver and a twisted pair line. In the following description specific details are set forth, such as materials and dimensions, in order to provide a thorough understanding of the present invention. It will be apparent, however, to one skilled in the art that the present invention may be practiced without these specific details. In other instances, well-known fabrication techniques, methods of winding, etc., are not described in detail in order not to unnecessarily obscure the present invention.

Figure 1:
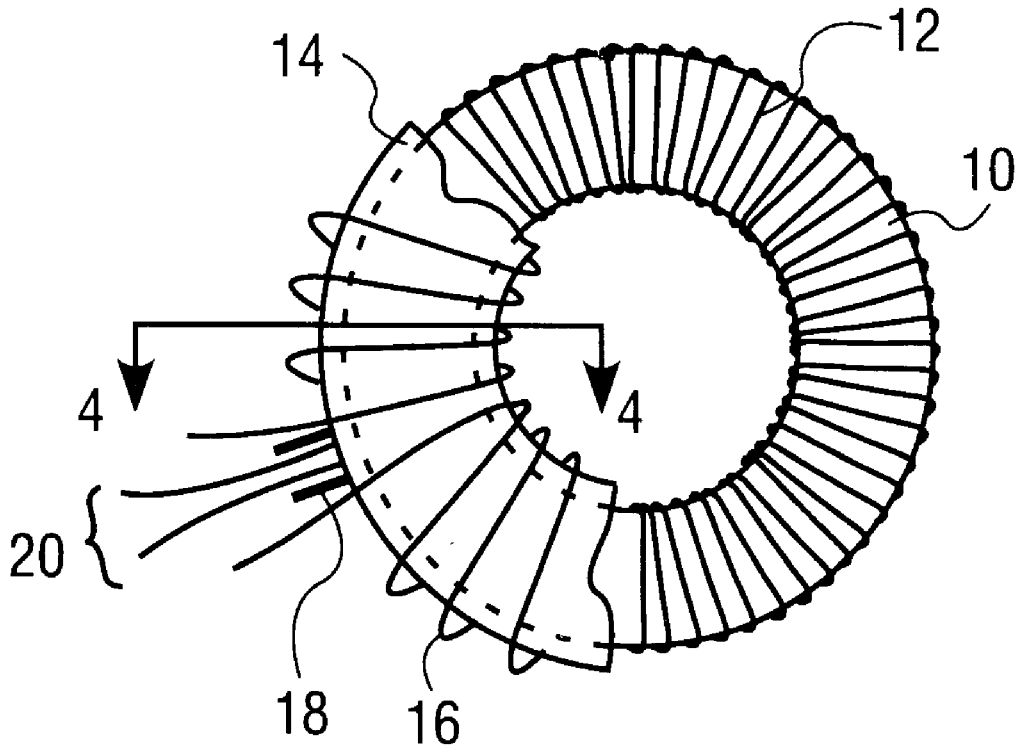
FIG. 1 is a plan view of the transformer with the separator cut away to reveal the first winding.

Referring first to FIG. 1 the transformer includes a toroidal-shaped magnetic core 10. Any one of numerous well-known magnetic materials may be used for the core 10. A first winding 12 is wound about and disposed over the core 10. In one embodiment, the winding 12 is wound about the entire core 10, that is, the winding encompasses 360° of the core 10 to the extent possible.

A separator 14 comprising a pair of annular-shaped cups fit over the winding 12. These cups define an interior space for receiving the core 10 and winding 12. As will be seen, the cups include a tab 18 having an opening to allow the ends 20 of the winding 10 to exit the interior of the separator 14. A second winding 16 is wound about the outer surface of the separator 14. This winding again is disposed about the entire surface (all 360° less the area taken by the tab) of the separator 14.

Figure 2B:
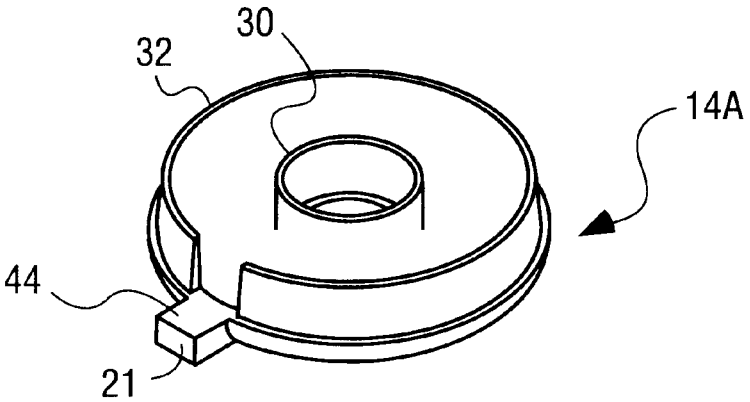
FIG. 2B is a perspective view of the cup of FIG. 2A.
Figure 2A:
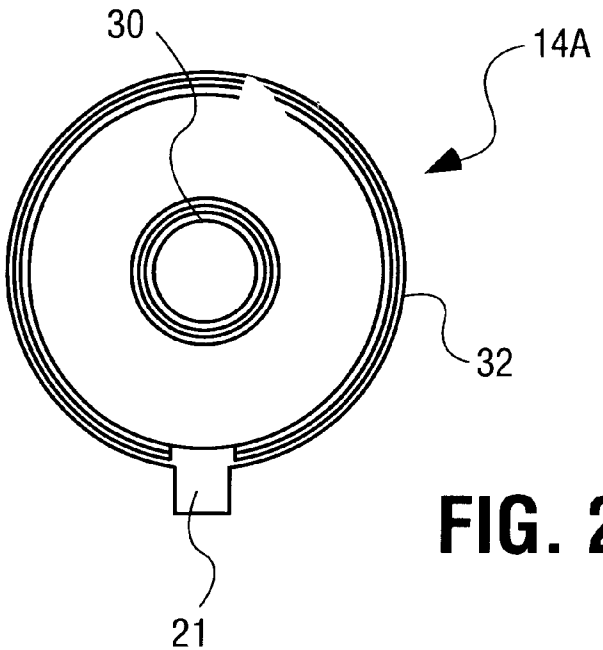
FIG. 2A is a plan view illustrating one of the annular-shaped cups forming the separator.

Referring first to FIGS. 2A and 2B, the cup 14*a* comprising one-half of the separator 14 is illustrated. The annular-shaped cup 14*a* includes a generally cylindrical outer wall 32 and an inner cylindrical wall 30. The space between these walls and the bottom surface of the cup define an interior space which houses the core and the first winding. A tab 21 expands from the bottom surface of the cup 14*a* and mates with a tab on the other cup.

Figure 3B:
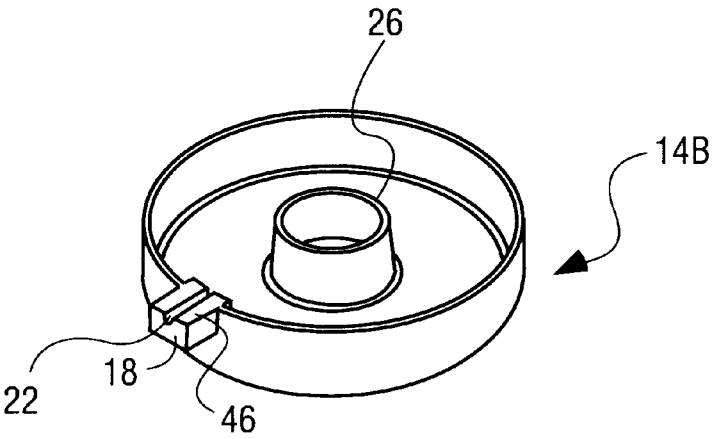
FIG. 3B is perspective view of the cup of FIG. 3A.
Figure 3A:
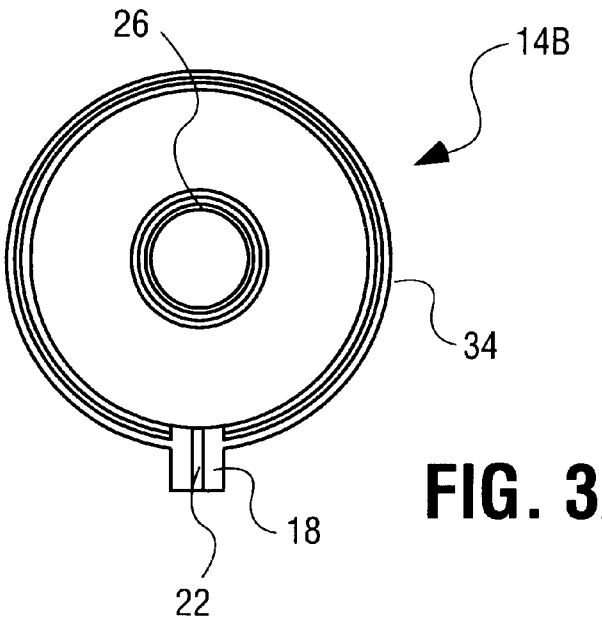
FIG. 3A is a plan view illustrating the other annular-shaped cup forming the separator.

The other half of the separator 14 comprising cup 14*b* is shown in FIGS. 3A and 3B. It again is an annular-shaped cup with an outer cylindrical wall 34 which slides over wall 32 of cup 14*a*. A tab 18 extends from the outer wall 34 and includes a notch 22 extending from the very furthest end of the tab 18 to the interior space of the cup 14*b*. When the cup 14*b* is mated to the cup 14*a*, the surface 46 of tab 18 contacts the surface 44 of the tab 21. These two tabs then define an opening notch 22 through which the ends of the first winding pass. This is important since it provides separation between the second winding wound about the exterior of the separator 14 and the ends of the first winding disposed within the interior of the separator 14. This spacing, as will be discussed is at least 0.4 mm and is sufficient to meet certain safety regulations mentioned later.

Preferably, the separator 14 is fabricated from a material having a low dielectric constant (low K) such as polypropylene, polyethylene, Teflon or other low K materials. This spacing between the winding with the low K material reduces the common mode noise transfer including both the sinusoidal and transient noise as well as the common mode emitted noise. Also safety isolation is easier.

Figure 4:
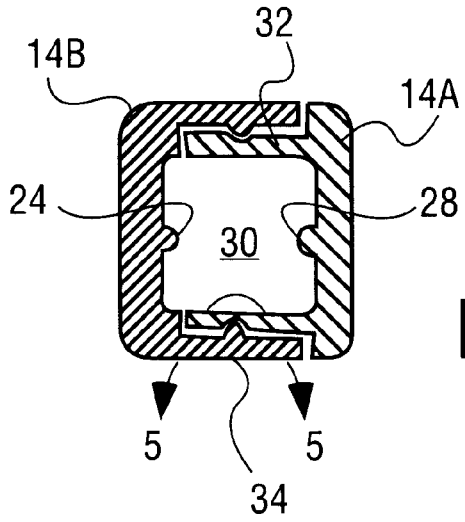
FIG. 4 is a cross-sectional elevation view of an alternate embodiment of the separator (without the core) generally taken through section lines 4—4 of FIG. 1.

Referring to FIG. 4 when the cup halves 14*a* and 14*b* are assembled, they define an interior space 30 for receiving the core and first winding.

By way of example, in one embodiment when the first and second windings are directly on one another without the use of the separator 14, approximately 45 pF of capacitance was found to exist between the windings. Where a polypropylene separator provides spacing of approximately 0.5 mm between the windings, this capacitance was reduced to approximately 6 pF. Additional decrease of capacitance may be achieved by using the ribs described later in conjunction with FIGS. 4 and 5. Also using the separator with the winding wound as discussed (approximately over 360° of the toroid) provided an improvement of 28 dB in the magnetic field induced noise when compared to the sector windings. Often with sector windings some of the common mode noise is converted to differential noise because of the imbalance in the winding technique. This problem is also greatly reduced with the invented transformer.

The tab 18 of FIG. 1 which is formed by the tabs 20 and 18 of FIGS. 2 and 3, respectively, provide sufficient separation between the ends of the first winding and the second winding to meet the standards of the Underwriter Laboratories (UL 1950) and the European equivalent (EN 950).

Figure 5:
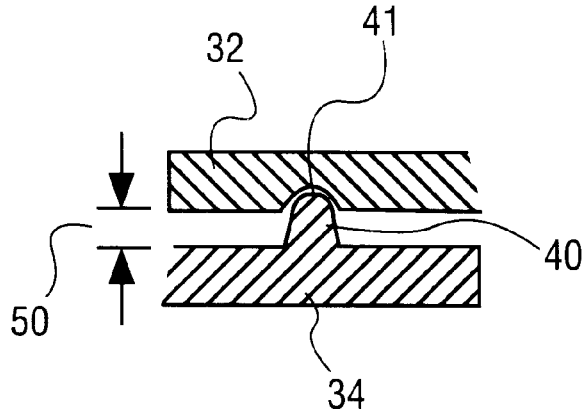
FIG. 5 is an enlarged view of the separator of FIG. 4 taken through section line 5—5 of FIG. 4.

In the alternate embodiment of FIGS. 4 and 5, the bottom surface of the cup 14*a* includes a circular rib 28 upon which the core and winding rest in order to provide additional air space between the first winding and the second winding. The interior of the cup 14*b* includes a circular rib 24 similar to the rib 28 of cup 14*a* to provide air space between the core and first winding and the second winding.

Additionally, a rib 40 is disposed about the inside surface of wall 34 of the cup 14*b* and engages a groove 41 disposed about the outside surface of wall 32 of the cup 14*a*. The rib 40 is taller than the depth of the groove 41 leaving an air gap 50. This provides a partial air dielectric along the sides of the core when used in conjunction with the ribs 24 and 28. In one embodiment the air gap 50 is approximately 2 mm.

Thus, a transformer with a separator is disclosed which can be easily fabricated and assembled.

What is claimed is:

1. A transformer comprising:

a toroidal core;

a first winding disposed about the toroidal core;

a winding separator fitted over the first winding, the winding separator comprising a pair of annular shaped cups defining an interior space encircling the first winding separator;

a second winding disposed about an outer surface of the winding seperator; and a pair of tabs, each tab extended from an outer wall of each annular shaped cup, only one tab from the pair of tabs comprising a notch extended from a furthest end of the tab to an interior space of the annular shaped cup.

2. The transformer defined by claim 1 including ribs on interior surfaces of the winding separator to provide additional separation between the first winding and the interior space of the winding separator.

3. The transformer defined by claim 1 wherein the first winding overlays substantially the toroidal core and the second winding overlays substantially the entire outer surface of the winding separator.

4. The transformer defined by claim 1 wherein the winding separator is fabricated from a low K material.

5. The transformer defined by claim 1 wherein the pair of tabs define an opening to permit ends of the first winding to exit the interior space of the winding separator.

* * * * *